US006971846B2

(12) United States Patent
Ochiai et al.

(10) Patent No.: US 6,971,846 B2
(45) Date of Patent: Dec. 6, 2005

(54) CENTRIFUGAL BLOWER

(75) Inventors: Toshinori Ochiai, Obu (JP); Manabu Miyata, Obu (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/751,853

(22) Filed: Jan. 6, 2004

(65) Prior Publication Data

US 2004/0136827 A1 Jul. 15, 2004

(30) Foreign Application Priority Data

Jan. 9, 2003 (JP) ..... 2003-003595

(51) Int. Cl.[7] ..... F04D 29/44
(52) U.S. Cl. ..... 415/203; 416/185
(58) Field of Search ..... 415/203, 204, 415/206, 212.1; 416/185, 186 R, 223 B, 416/DIG. 2

(56) References Cited

U.S. PATENT DOCUMENTS 4,884,946 A * 12/1989 Belanger et al. ..... 415/206
5,145,317 A * 9/1992 Brasz ..... 415/224.5
5,601,400 A * 2/1997 Kondo et al. ..... 415/119
5,743,710 A * 4/1998 Yapp ..... 415/208.2
6,210,109 B1 * 4/2001 Will et al. ..... 415/204
6,224,335 B1 * 5/2001 Parisi et al. ..... 415/206
6,604,906 B2 * 8/2003 Ozeki et al. ..... 415/204

FOREIGN PATENT DOCUMENTS

JP 62282200 A * 12/1987 ..... F04D 29/46
JP 5-195995 8/1993

* cited by examiner

*Primary Examiner*—Edward K. Look
*Assistant Examiner*—Igor Kershteyn
(74) *Attorney, Agent, or Firm*—Harness, Dickey & Pierce, PLC

(57) ABSTRACT

In a centrifugal blower, a casing forms a scroll duct on the outer periphery of a centrifugal fan. The scroll duct includes a motor scroll duct wall extending from the periphery of a motor casing wall in a radial direction, a suction scroll duct wall extending from the periphery of a suction casing wall in an axial direction, and an outer peripheral wall smoothly connecting the motor scroll duct wall and the suction scroll duct wall. The scroll duct walls include curves having substantially arc-shaped cross-sections. A radius of curvature of the arc of the motor scroll duct wall is greater than that of the suction scroll duct wall. The scroll duct does not form a protrusion in the inside. The air discharged from the fan creates a secondary flow in a single course of a swirling flow in the scroll duct. Therefore, noise due to interference with the discharging flow and secondary flow reduces.

13 Claims, 8 Drawing Sheets

CENTRIFUGAL BLOWER

CROSS REFERENCE TO RELATED APPLICATION

This application is based on Japanese Patent Application No. 2003-3595 filed on Jan. 9, 2003, the disclosure of which is incorporated herein by reference.

FIELD OF THE INVENTION

The present invention relates to a centrifugal blower for a vehicle air conditioner.

BACKGROUND OF THE INVENTION

A centrifugal blower is generally constructed of a scroll casing and a centrifugal fan housed in the scroll casing. The scroll casing includes a suction side casing wall, a motor side casing wall that is parallel with the suction side casing wall, and a peripheral wall connecting the peripheries of the suction side casing wall and the motor side casing wall. The suction side casing wall defines a suction port in a central position and forms a bell mouth on the periphery of the suction port. A motor is fixed to the central portion of the motor side casing wall. Also, the scroll casing forms a blowing passage in a form of scroll between the periphery of the centrifugal fan and the peripheral wall. A radial dimension of the blowing passage increases toward an air downstream position. The scroll casing forms a blowing outlet at the downstream position of the blowing passage. The blowing outlet connects to a blowing duct. Further, the blowing duct connects to an air conditioner duct of an air conditioner unit.

With regard to a centrifugal blower disclosed in JP-A-5-195995, a scroll side casing wall is protruded in an axial direction at a position corresponding to a blowing passage to restrict pressure loss and to reduce noise problem. Thus, the blowing passage and a space in the protruded portion form a scroll passage.

Further, in such kind of scroll casing, it is proposed that protruded portions 150*b* have substantially rectangular-shaped cross-sections to facilitate creation of a secondary flow E2 in a scroll passage 150, as shown in FIG. 11. In this case, two separate courses of small swirling flows are created as the secondary flows E2 by the protruded passage areas 150*b*, and the pressure loss and noise are reduced within a wide air blowing region where the flow rate of a centrifugal blower 100 changes. However, the velocity difference between the small swirling flow E2 and a discharging flow E1 from a centrifugal fan 104 is large, for example. As a result, it is still difficult to reduce noise sufficiently.

SUMMARY OF THE INVENTION

The present invention is made in view of the foregoing matter and it is an object of the present invention to provide a centrifugal blower capable of creating a single course of a swirling secondary flow in a scroll air passage, thereby to reduce noise.

According to a centrifugal blower of the present invention, a centrifugal fan is housed in a scroll casing and driven by a motor. The centrifugal fan includes a boss portion, a plurality of blades arranged on the periphery of the boss portion in parallel with an axial direction of the centrifugal fan, and a shroud connecting the ends of the blades. The shroud defines a fan inlet port through which air is sucked in the centrifugal fan and the blades defines discharging ports through which air is discharged in a radially outward direction. The motor is connected to the boss portion. The scroll casing includes a first casing wall defining a casing suction port, a second casing wall opposing the first casing wall, and a scroll duct connecting an outer periphery of the first casing wall and an outer periphery of the second casing wall. The centrifugal fan is disposed in the scroll casing such that the fan inlet port is adjacent to the casing suction port. The motor is fixed to the second casing wall. The scroll duct includes a first wall portion, a second wall portion, and a third wall portion.

Preferably, the first wall portion extends from the outer periphery of the first casing wall in the axial direction and including a curve. The second wall portion extends from the outer periphery of the second casing wall in the radial direction and including a curve. The third wall portion smoothly connecting the first wall portion and the second wall portion. The curve of the first wall portion has a radius of curvature smaller than that of the second wall portion. Therefore, the scroll duct is formed with a smoothly curved continuous wall without having a protrusion. Air blown by the centrifugal fan is discharged in the scroll duct. The discharged air flows toward a blowing outlet while creating a secondary flow. Because the secondary flow is in a single course of swirling flow, noise due to interference of the discharging flow from the centrifugal fan and the secondary flow can be reduced.

Alternatively, the first wall portion extends in the radial direction and the second wall portion extends in the axial direction. The curve of the first wall portion has a radius of curvature larger than that of the second wall portion.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENTS

Embodiments of the present invention will be described hereinafter with reference to the drawings.

Figure 1:
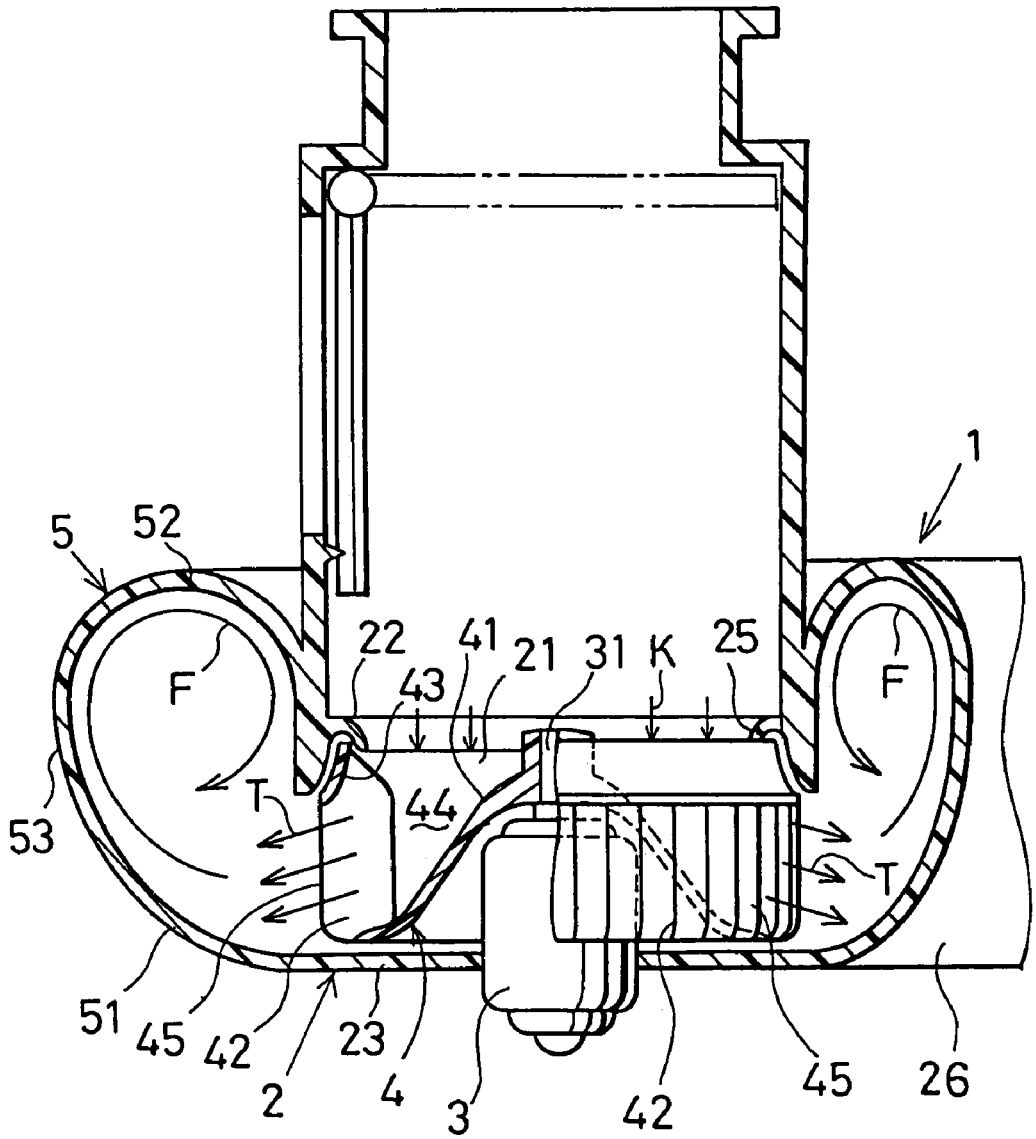
FIG. 1 is a cross-sectional view of a centrifugal blower according to the first embodiment of the present invention.
Figure 2:
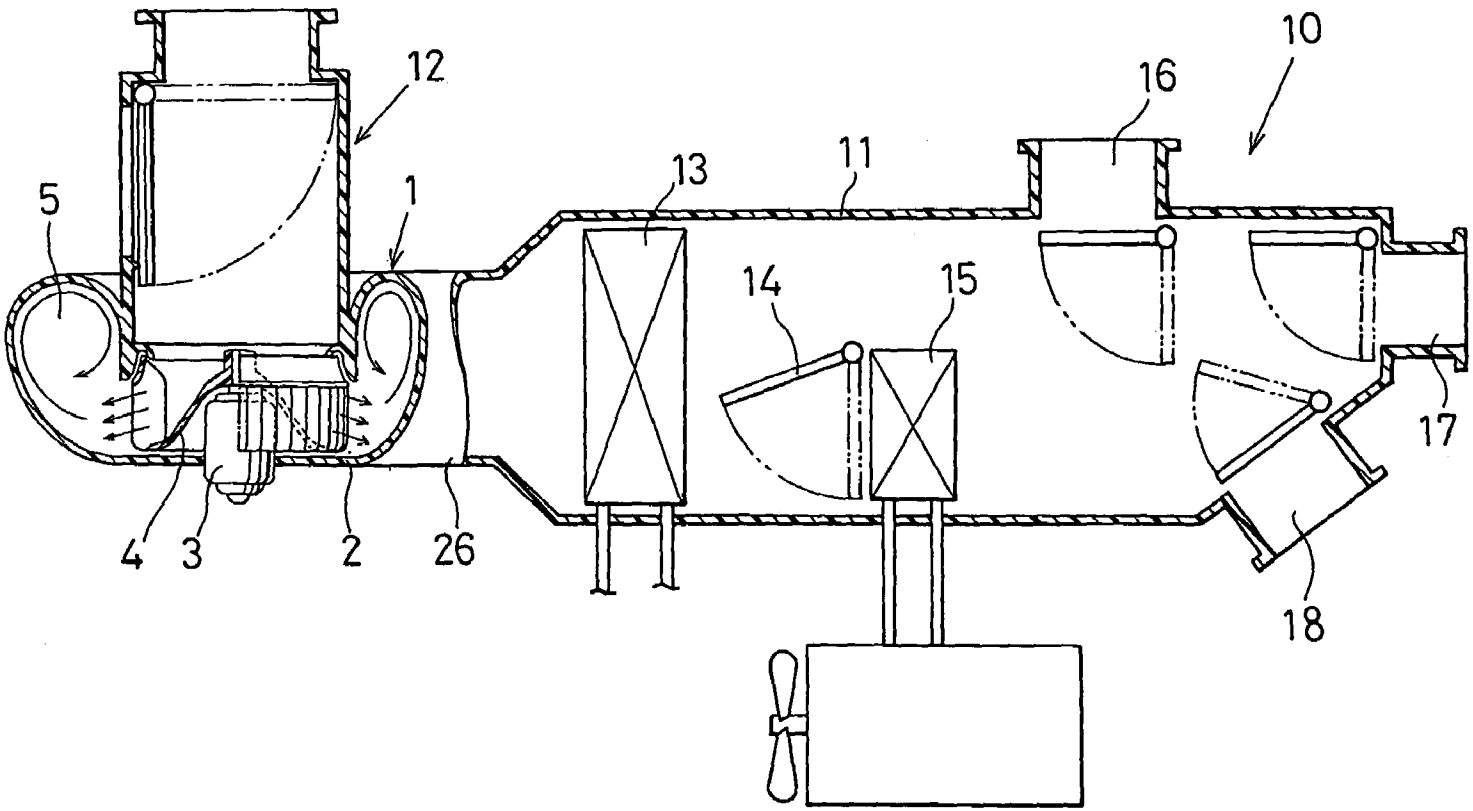
FIG. 2 is a schematic diagram of a vehicle air conditioner having the centrifugal blower according to the first embodiment of the present invention.

Referring to FIG. 1, a centrifugal blower 1 of the first embodiment is used for a vehicle air conditioner 10 shown in FIG. 2. The centrifugal blower 1 has a casing 2, a fan motor 3, and a centrifugal fan 4. The centrifugal fan 4 is housed in the casing 2 and driven by the fan motor 3. In the embodiment, the centrifugal fan 4 is a sirocco fan, for example.

The casing 2 includes a suction side casing wall 22 (upper wall in FIG. 1), a motor side casing wall 23 (lower wall in FIG. 1), and a scroll duct 5 connecting the peripheries of the suction side casing wall 22 and the motor side casing wall 23. The suction side casing wall 22 and the motor side casing wall 23 have the diameter corresponding to an outside diameter of the centrifugal fan 4. The suction side casing wall 22 defines a suction port 21 through which air is sucked into the casing 2, in its middle position. Also, the suction side casing wall 22 includes a bell mouth 25 on the periphery of the suction port 21. The fan motor 3 is fixed to the middle portion of the motor side casing wall 23. The scroll duct 5 defines a blowing passage through which air blown by the centrifugal fan 4 flows.

As shown in FIG. 2, the centrifugal blower 1 is arranged at an upstream position of an air conditioner duct 11 of the vehicle air conditioner 10 for supplying air into the air conditioner duct 11. An inside/outside air switching box 12 is provided at a position upstream of the centrifugal blower 1. A housing of the inside/outside air switching box 12 connects to the periphery of the suction side casing wall 22. An evaporator 13, an air mix door 14, and a heater core 15 are accommodated in the air conditioner duct 11. The evaporator 13 communicates with a vehicle refrigerant cycle system. The air mix door 14 is provided to control a temperature of air. An engine cooling water circulates in the heater core 15. Further, the air conditioner duct 11 forms a defroster opening 16, a foot opening 17 and a face opening 18 at the downstream position.

The fan 4 includes a boss portion 41, a plurality of blades 42 and a shroud 43. The boss portion 41 is connected to a rotation shaft 31 of the fan motor 3. The middle portion of the boss portion 41 protrudes toward the suction port 21 in a form of substantially dome. The blades 42 are arranged on the periphery of the boss portion 41 at equal intervals with respect to a rotation axis. The blades 42 are in parallel with the rotation axis. The top ends of the blades 42 connect to the shroud 43. The shroud 43 has an annular shape and defines a fan suction port (inlet port) 44 on the inner periphery of the annular shape for sucking air in an axial direction. The fan 4 defines air discharging ports 45 on the outer periphery, that is, between the outer peripheral ends of the blades 42, for blowing air in a radial direction.

Figure 3:
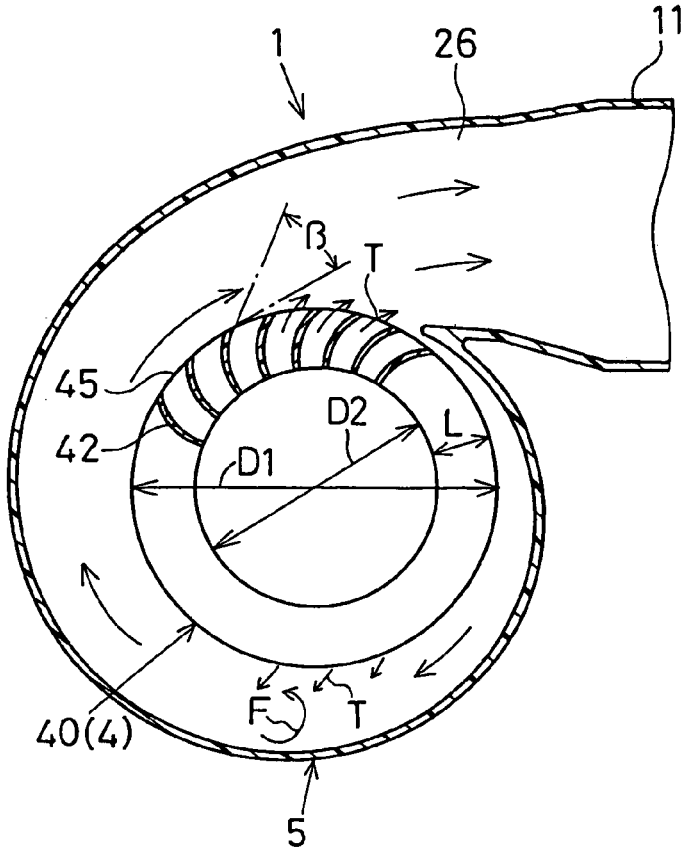
FIG. 3 is a plan view of a centrifugal fan of the centrifugal blower according to the first embodiment of the present invention.

As shown in FIG. 3, in the embodiment, a sirocco fan 40 is used as the centrifugal fan 4. Here, reference numeral D1 denotes an outside diameter of the fan 40. Reference numeral D2 denotes an inside diameter of the fan 40. Reference numeral L denotes a dimension (wing length) of each blade 42. Here, the ratio of the dimension L of the blade 42 to the inside diameter D1 of the fan 40 is equal to or grater than 0.12. Also, the blade dimension L satisfies an equation $L=(D1-D2)/2$. The blades 42 are curved forward with respect to a rotation direction of the fan 40. The blade 42 forms a discharging angle $\beta$ equal to or less than 90 degrees. Because the sirocco fan produces a large volume of air as compared with another fan, it is preferable to use in the centrifugal blower 1. However, a fan such as a radial fan can be used as the centrifugal fan 4 instead of the sirocco fan.

The scroll duct 5 includes a motor scroll wall (first scroll duct wall) 51, a suction scroll wall (second scroll duct wall) 52, and an outer peripheral wall (third scroll duct wall) 53 smoothly connecting the motor scroll wall 51 and the suction scroll wall 52. The motor scroll wall 51 smoothly extends from an outer periphery of the motor side casing wall 23 in the radial direction. The suction scroll wall 52 smoothly extends from the outer periphery of the suction side casing wall 22 in the axial direction. The motor scroll wall 51 and the suction scroll wall 52 include curves having arc-shaped cross-sections. The radius of curvature of the arc of the motor scroll wall 51 is greater than that of the suction scroll wall 52. The scroll duct 5 defines a blowing outlet 26 of the centrifugal blower 1 at its downstream end. The blowing outlet 26 connects to the upstream end of the air conditioner duct 11.

In operation of the centrifugal fan 4, air K is sucked in the centrifugal fan 4 from the suction port 21 and further from the inlet port 44 and discharged from the discharging ports 45 into the scroll duct 5 as in a discharging flow (primary flow) T. The discharging flow T includes a radial component and a rotation component by the centrifugal force, and further includes an axial component by being sucked in the axial direction. Therefore, the discharging flow T directs rather downward when discharging in the scroll duct 5. The air discharged in the scroll duct 5 is blown into the air conditioner duct 11 through the blowing outlet 26.

In the scroll duct 5, the air flows toward the blowing port 26 while creating a secondary flow F. Specifically, while flowing toward the blowing port 26, the discharged air collides with the motor scroll wall 51, directs upward, and turns toward the center along the suction scroll wall 52, thereby creating the swirling secondary flow F. In the embodiment, the secondary flow F is a single course of a swirling flow. Therefore, the secondary flow F is smooth and turbulence of the secondary flow F is reduced, as compared with the case of creating two separate course of swirling flows E2 shown in FIG. 11.

Accordingly, the flow velocity difference at a position where the secondary flow F and the discharging flow T merge with each other is small. Therefore, noise is reduced. If a projection projecting to the inside of the scroll duct 5 exists for example on the peripheral wall 53, it is difficult to make the swirling secondary flow smooth. This may result in a deterioration of noise reduction effect. Therefore, it is preferable to form the motor scroll wall 51, the suction scroll wall 52 and the outer peripheral wall 53 with a smooth continuous wall.

Figure 11:
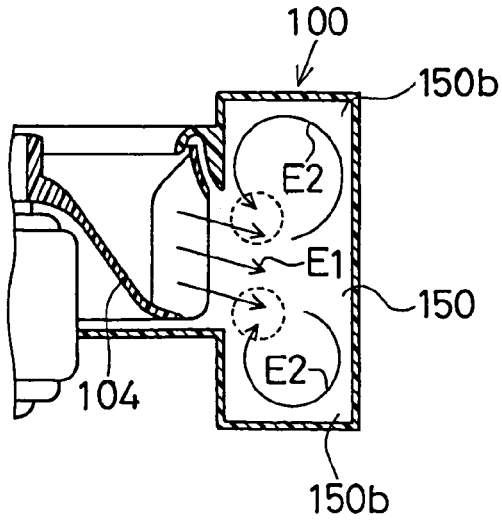
FIG. 11 RELATED ART
FIG. 11 is a cross-sectional view of a centrifugal blower of a related art.

FIGS. 4A to 6B are graphs showing measured results of noise levels and the like of the vehicle air conditioner 10 having the centrifugal blower 1 of the present invention and a vehicle air conditioner having the centrifugal blower 100 of FIG. 11 as a comparison example. In the graphs, a solid line with black squares represents the result of the present invention and a broken line with circles represents the result of the comparison example 100.

Figure 4A:
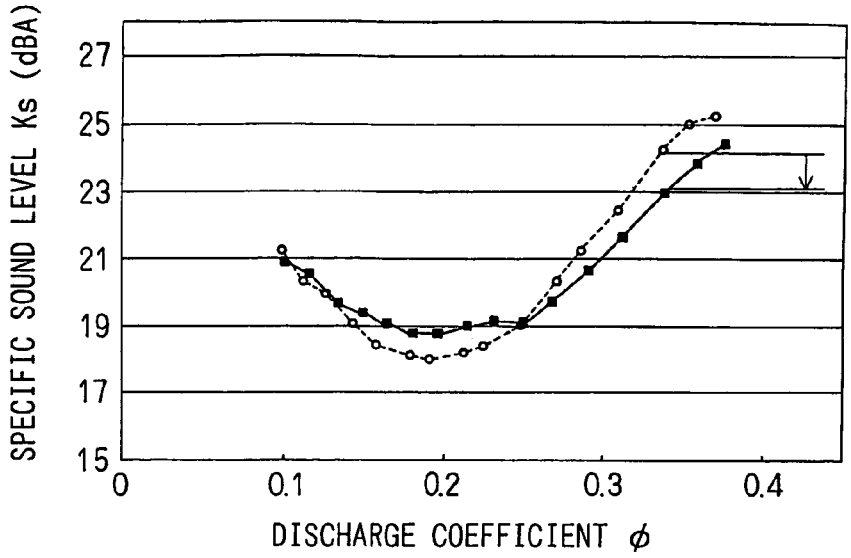
FIG. 4A is a graph for showing a relationship between a discharge coefficient and a specific sound level of the centrifugal blower according to the first embodiment of the present invention.
Figure 4B:
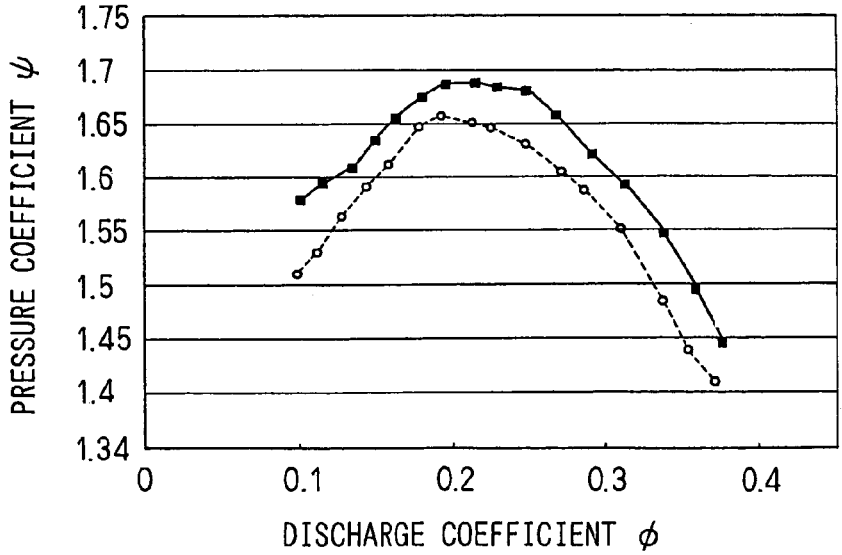
FIG. 4B is a graph for showing a relationship between the discharge coefficient and a pressure coefficient of the centrifugal blower according to the first embodiment of the present invention.

FIG. 4A shows a relationship between a discharge coefficient $\phi$ and a specific sound level Ks. In a range where the air volume is relatively high, that is, in a face mode, the specific sound level Ks of the centrifugal blower 1 is approximately 1 decibel lower than that of the comparison blower 100. FIG. 4B shows a relationship between the discharge coefficient $\phi$ and a pressure coefficient $\psi$. The pressure coefficient of the present invention is higher than that of the comparison example within a whole pressure loss range.

Figure 5:
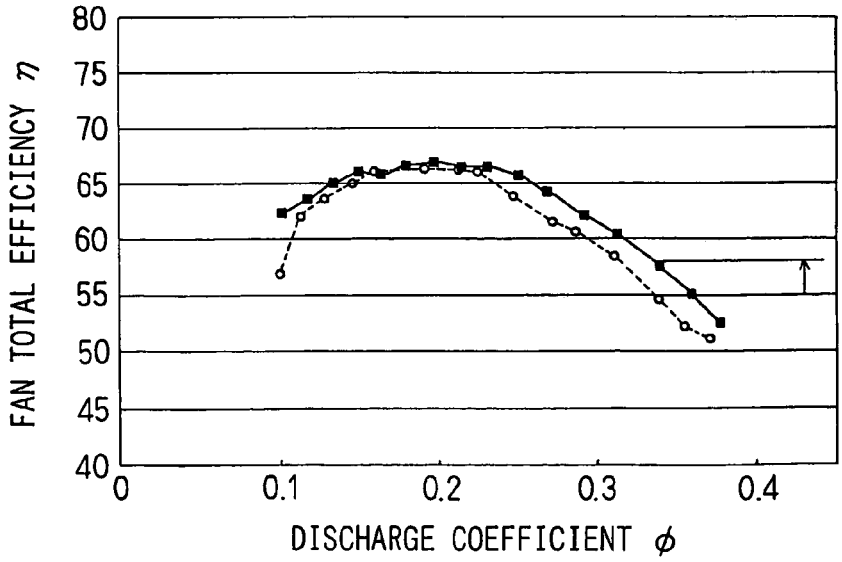
FIG. 5 is a graph for showing a relationship between the discharge coefficient and a fan total efficiency of the centrifugal blower according to the first embodiment of the present invention.

FIG. 5 shows a relationship between the discharge coefficient $\phi$ and a fan total efficiency $\eta$. The fan efficiency of the centrifugal blower 1 of the present invention is approximately 5% higher than that of the comparison blower 100, within the range where the air volume is relatively high, that is, in the face mode.

Figure 6A:
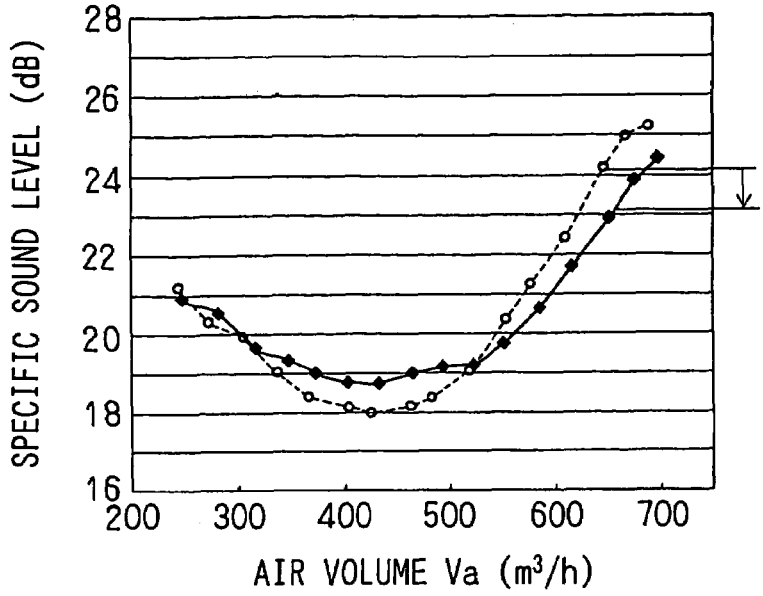
FIG. 6A is a graph for showing a relationship between an air volume and the specific sound level of the centrifugal blower according to the first embodiment of the present invention.
Figure 6B:
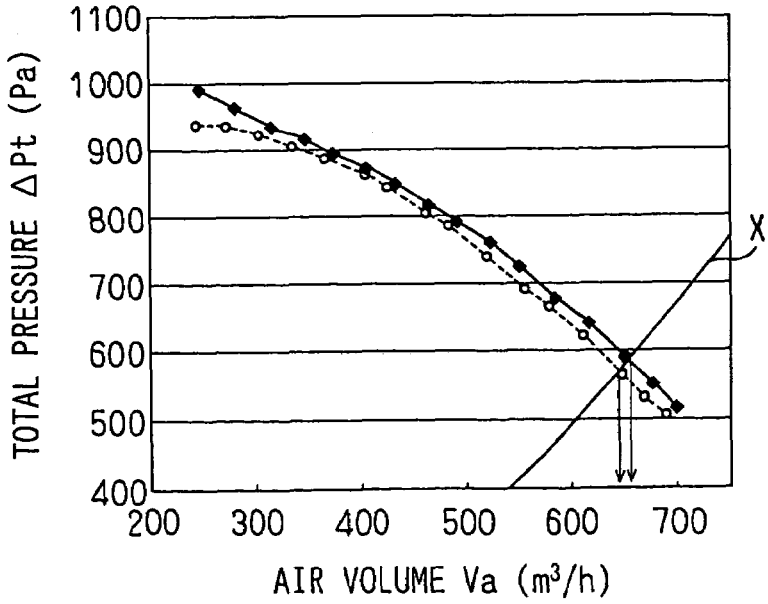
FIG. 6B is a graph for showing a relationship between the air volume and a total pressure of the centrifugal blower according to the first embodiment of the present invention.

FIG. 6A shows a relationship between an air volume Va and the specific sound level. Within a range where the air volume is relatively high, the specific sound level of the centrifugal blower 1 is approximately 1 decibel lower than that of the comparison blower 100 under the same air flow rate resistance. FIG. 6B shows a relationship between the air volume Va and a total pressure $\Delta$Pt. The air volume of the centrifugal blower 1 is approximately 10 $m^3$ greater than that of the comparison blower 100. In FIG. 6B, a solid line X shows an air resistance curve of a face mode.

Figure 7:
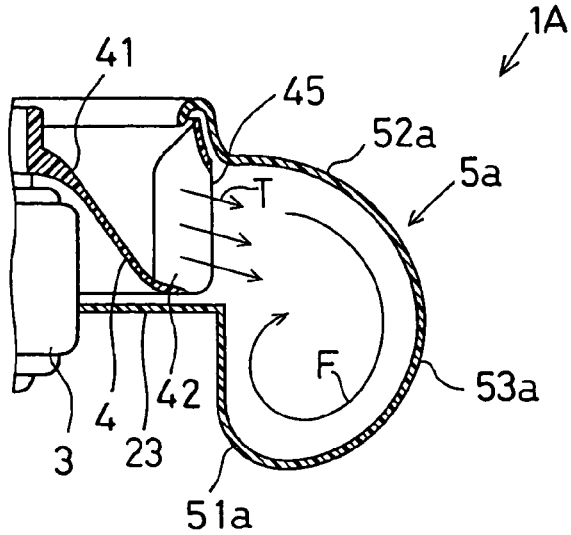
FIG. 7 is a cross-sectional view of a centrifugal blower according to the second embodiment of the present invention.

FIG. 7 shows a centrifugal blower 1A of the second embodiment. The centrifugal blower 1A has a scroll duct 5*a* including a motor scroll wall 51*a*, a suction scroll wall 52*a* and an outer peripheral wall 53*a*. The motor scroll wall 51*a* extends in the axial direction from the outer peripheral end of the motor casing wall 23. The suction scroll wall 52*a* smoothly extends from the outer peripheral end of the suction casing wall 22 in the radial direction. The motor scroll wall 51*a* and the suction scroll wall 52*a* include curves having the arc-shaped cross-sections. The radius of curvature of the arc of the suction scroll wall 52*a* is greater than that of the motor scroll wall 51*a*. The outer peripheral wall 53*a* smoothly connects the motor scroll wall 51*a* and the suction scroll wall 52*a*.

In this embodiment, the discharging flow T directs toward the outer peripheral wall 53*a* and creates the single course of swirling secondary flow F in the inner periphery of the motor scroll wall 51*a*. Accordingly, the centrifugal blower 1A of the second embodiment provides advantageous effect similar to those of the first embodiment.

Figure 8A:
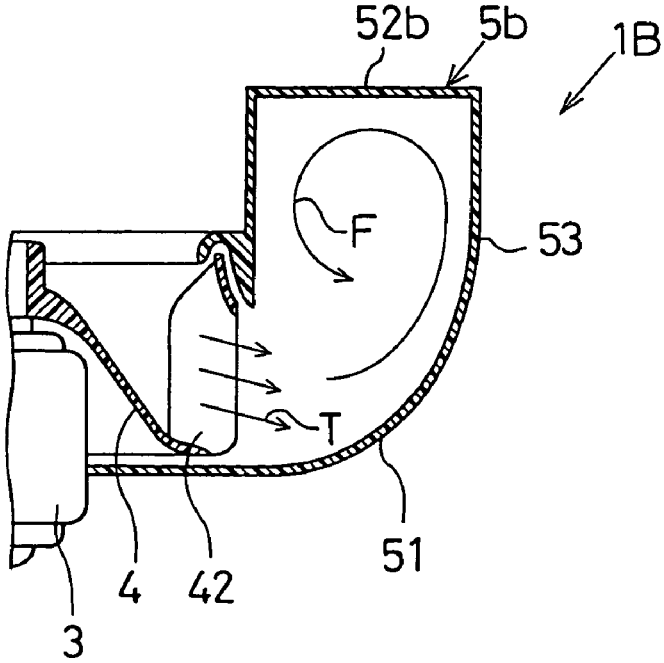
FIG. 8A is a cross-sectional view of a centrifugal blower according to the third embodiment of the present invention.

FIG. 8A shows a centrifugal blower 1B of the third embodiment. A scroll duct 5*b* of the centrifugal blower 1B has the motor scroll wall 51, a suction scroll wall 52*b*, and the outer peripheral wall 53. The suction scroll wall 52*b* has a substantially rectangular-shaped cross-section. In this embodiment, the single course of the swirling secondary flow F is created in the inner periphery of the suction scroll wall 52*b*. Since the secondary flow F is in the single course of the swirling flow, interference of the secondary flow F with the discharging flow T is reduced. Accordingly, the third embodiment provides noise reduction effect, similar to the first embodiment.

Figure 8B:
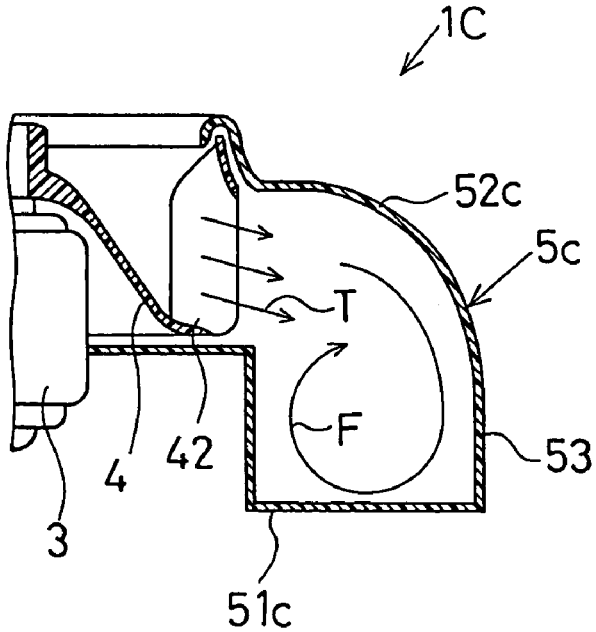
FIG. 8B is a cross-sectional view of a centrifugal blower according to the fourth embodiment of the present invention.

FIG. 8B shows a centrifugal blower 1C of the fourth embodiment. A scroll duct 5*c* of the fourth embodiment has a motor scroll wall 51*c*, the suction scroll wall 52*a*, and the outer peripheral wall 53. The motor scroll wall 51*c* has a substantially rectangular-shaped cross-section. In this embodiment, the secondary flow F is created in the inner periphery of the motor scroll wall 51*c*. Since the secondary flow F is in the single course of a swirling flow, interference of the secondary flow F with the discharging flow T is reduced. Accordingly, the fourth embodiment provides noise reduction effect, similar to the first embodiment.

Figure 9:
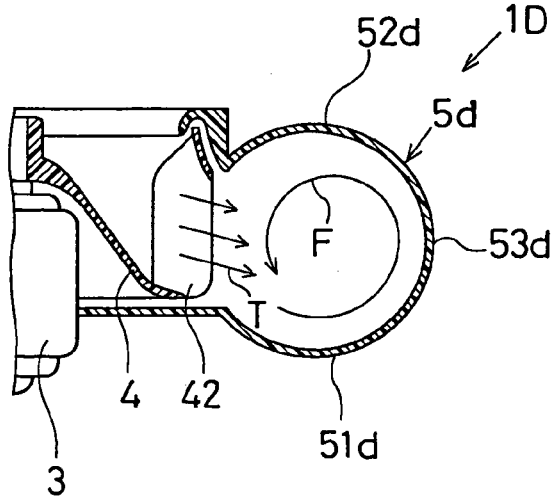
FIG. 9 is a cross-sectional view of a centrifugal blower according to the fifth embodiment of the present invention.

FIG. 9 shows a centrifugal blower 1D of the fifth embodiment. A scroll duct 5*d* of the fifth embodiment has a motor scroll wall 51*d*, a suction scroll wall 52*d* and an outer peripheral wall 53*c* of the scroll duct 5*d* each having an arc-shaped cross-section. Further, the arc shapes have the common center. Therefore, the scroll duct 5*d* has a substantially circular-shaped cross-section. In the scroll duct 5*d*, the discharging flow T creates the secondary flow F in the single course of swirling flow. Therefore, the interference with the discharging flow T and the secondary flow F is reduced, thereby reducing noise.

Figure 10A:
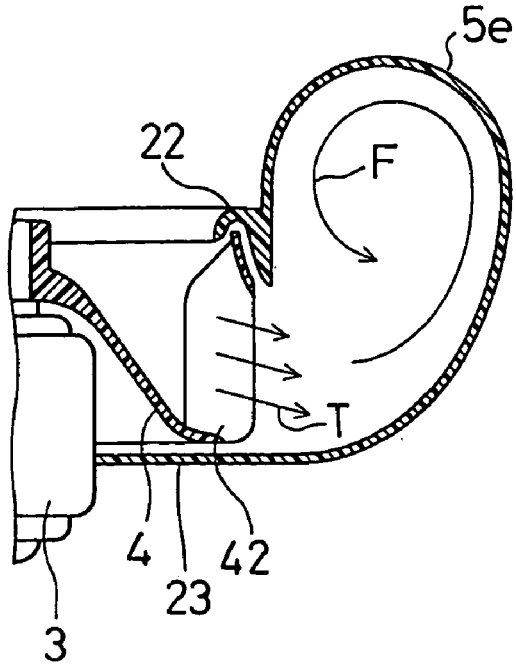
FIG. 10A is a cross-sectional view of a centrifugal blower according to the sixth embodiment of the present invention.

FIG. 10A shows a scroll duct 5*e* of the sixth embodiment. The scroll duct 5*e* has a substantially elliptic-shaped cross-section. The scroll duct 5*e* protrudes upward. That is, the center of the elliptic shape is closer to the suction side casing wall 22 that the motor side scroll casing 23 with respect to the axial direction. Also in the sixth embodiment, the secondary flow F is in the single course of a swirling flow. Accordingly, the sixth embodiment provides advantageous effects similar to the first embodiment.

Figure 10B:
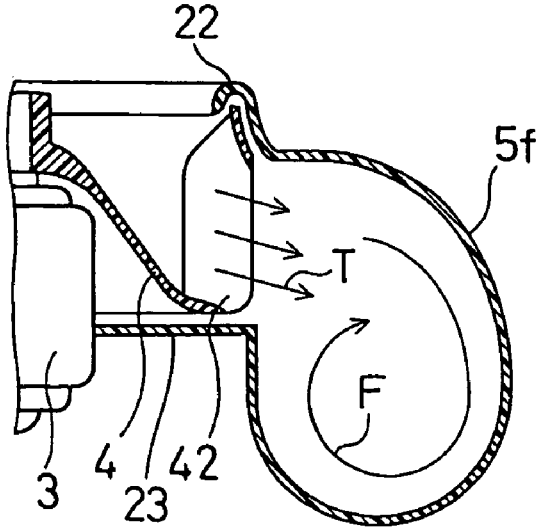
FIG. 10B is a cross-sectional view of a centrifugal blower according to the seventh embodiment of the present invention.

FIG. 10B shows a scroll duct 5*f* of the seventh embodiment. The scroll duct 5*f* has a substantially elliptical-shaped cross-section. The scroll duct 5*f* protrudes downward. That is, the center of the elliptic shape is closer to the motor side casing wall 23 than the suction side casing wall 22 with respect to the axial direction. Also in the seventh embodiment, the secondary flow F is in the single course of a swirling flow. Accordingly, the seventh embodiment provides advantageous effects similar to the first embodiment.

The present invention should not be limited to the disclosed embodiment, but may be implemented in other ways without departing from the spirit of the invention.

What is claimed is:

1. A centrifugal blower comprising:

a centrifugal fan including a boss portion, a plurality of blades arranged on a periphery of the boss portion in parallel to an axial direction, and a shroud connecting to ends of the blades, wherein the shroud defines a fan inlet port through which air is sucked in the centrifugal fan and the blades define discharging ports through which air is discharged in a radial direction;

a motor connected to the boss portion for driving the centrifugal fan; and a scroll casing including a first casing wall defining a casing suction port, a second casing wall opposing the first casing wall and holding the motor, and a scroll duct connecting an outer periphery of the first casing wall and an outer periphery of the second casing wall; wherein the scroll casing houses the centrifugal fan such that the fan inlet port is adjacent to the casing suction port;

the scroll duct includes a first wall portion that extends from the outer periphery of the first casing wall and includes a curve, a second wall portion that extends from the outer periphery of the second casing wall and includes a curve, and a third wall portion connecting the first wall portion and the second wall portion;

the first wall portion extends from the outer periphery of the first casing wall in the axial direction and the second wall portion extends from the outer periphery of the second casing wall in the radial direction;

the curve of the first wall portion has a radius of curvature smaller than that of the second wall portion; and the third wall portion smoothly connecting the first wall portion and the second wall portion so that the scroll duct has a radius of curvature that gradually reduces from the second wall portion to the first wall portion.

2. The centrifugal blower according to claim 1, wherein the scroll duct has a substantially elliptic-shaped cross-section.

3. The centrifugal blower according to claim 1, wherein the scroll duct has a cross-sectional shape that is provided by a combination of arcs.

4. The centrifugal blower according to claim 1, wherein the centrifugal blower is formed such that a ratio of a dimension of each blade with respect to the radial direction to an outside diameter of the centrifugal blower is equal to or greater than 0.12.

5. The centrifugal blower according to claim 4, wherein the centrifugal blower is a sirocco fan and the blades are curved forward with respect to a rotation direction.

6. A centrifugal blower comprising:

a centrifugal fan including a boss portion, a plurality of blades arranged on a periphery of the boss portion in parallel to an axial direction, and a shroud connecting to ends of the blades, wherein the shroud defines a fan inlet port through which air is sucked in the centrifugal fan and the blades define discharging ports through which air is discharged in a radial direction;

a motor connected to the boss portion for driving the centrifugal fan; and a scroll casing including a first casing wall defining a casing suction port, a second casing wall opposing the first casing wall and holding the motor, and a scroll duct connecting an outer periphery of the first casing wall and an outer periphery of the second casing wall; wherein the scroll casing houses the centrifugal fan such that the fan inlet port is adjacent to the casing suction port;

the scroll duct includes a first wall portion that extends from the outer periphery of the first casing wall and includes a curve, a second wall portion that extends from the outer periphery of the second casing wall and includes a curve, and a third wall portion connecting the first wall portion and the second wall portion;

the first wall portion extends from the outer periphery of the first casing wall in the radial direction and the second wall portion extends from the outer periphery of the second casing wall in the axial direction;

the curve of the first wall portion has a radius of curvature larger than that of the second wall portion; and the third wall portion smoothly connecting the first wall portion and the second wall portion so that the scroll duct has a radius of curvature that gradually reduces from the first wall portion to the second wall portion.

7. The centrifugal blower according to claim 6, wherein the scroll duct has a substantially elliptic-shaped cross-section.

8. The centrifugal blower according to claim 6, wherein the scroll duct has a cross-sectional shape that is provided by a combination of arcs.

9. The centrifugal blower according to claim 6, wherein the centrifugal blower is formed such that a ratio of a dimension of each blade with respect to the radial direction to an outside diameter of the centrifugal blower is equal to or greater than 0.12.

10. The centrifugal blower according to claim 9, wherein the centrifugal blower is a sirocco fan and the blades are curved forward with respect to a rotation direction.

11. The centrifugal blower according to claim 6, wherein the scroll duct has one of a substantially circular-shaped cross-section, a substantially elliptic-shaped cross-section, and a cross-sectional shape provided by a combination of arc shapes.

12. A centrifugal blower comprising:

a centrifugal fan including a boss portion, a plurality of blades arranged on a periphery of the boss portion in parallel to an axial direction of the centrifugal fan, and a shroud connecting to ends of the blades, wherein the shroud defines a fan inlet port through which air is sucked in the centrifugal fan and the blades define discharging ports through which air is discharged in a radially outward direction;

a motor connected to the boss portion for driving the centrifugal fan; and a scroll casing including a first casing wall defining a casing suction port, a second casing wall opposing the first casing wall and holding the motor, and a scroll duct connecting an outer periphery of the first casing wall and an outer periphery of the second casing wall, wherein the scroll casing houses the centrifugal fan such that the fan inlet port is adjacent to the casing suction port, and the scroll duct includes a first wall portion that extends from one of the first casing wall and the second casing wall in the radial direction and then curves toward the axial direction, a second wall portion that extends from the other one of the first casing wall and the second casing wall in the axial direction so that the second wall portion defines a space axially outside of the other one of the first casing wall and the second casing wall, and a third wall portion smoothly connecting the first wall portion and the second wall; wherein the second wall portion has a substantially rectangular-shaped cross-section.

13. The centrifugal blower according to claim 1, wherein the scroll duct has one of a substantially circular-shaped cross-section, a substantially elliptic-shaped cross-section, and a cross-sectional shape provided by a combination of arc shapes.

* * * * *